United States Patent [19]

Dighe et al.

[11] Patent Number: 4,780,132

[45] Date of Patent: Oct. 25, 1988

[54] PLASMA FIRED CUPOLA

[75] Inventors: Shyam V. Dighe, North Huntingdon, Pa.; William H. Provis, Port Washington, Wis.

[73] Assignee: Electric Power Research Institute, Palo Alto, Calif.

[21] Appl. No.: 47,809

[22] Filed: May 8, 1987

[51] Int. Cl.[4] ..... C22B 4/00

[52] U.S. Cl. ..... 75/10.22; 75/10.12; 75/44 S

[58] Field of Search ..... 75/10.12, 10.22, 44 S

[56] References Cited

U.S. PATENT DOCUMENTS 4,530,101 7/1985 Fey ..... 373/19

4,707,183 11/1987 Michard ..... 75/10.22

*Primary Examiner*—Peter D. Rosenberg

*Attorney, Agent, or Firm*—Fred J. Baehr, Jr.

[57] ABSTRACT

A plasma-fired cupola may be operated at very low gas flow levels in the range of 0.9 SCFM per sq. inch of cupola cross-sectional area and with recirculated off-gas substantially reducing the rate at which coke is burned thus reducing the sulfur content of the iron produced also alloying elements may be added as ferrous-alloys or as alloy oxides through the plasma torch with or without recirculated off-gas and/or pulverized coke to rapidly change the chemical composition of the iron being formed.

14 Claims, 2 Drawing Sheets

PLASMA FIRED CUPOLA

BACKGROUND OF THE INVENTION

This invention relates to a cupola and more particularly to a cupola which receives part of its heat input from a plasma torch.

The plasma-fired cupola is a vertical cylindrical shaft furnace in which a plasma torch is fitted. The plasma torch and nozzle are described in a patent application entitled "Plasma Fired Feed Nozzle" filed May, 8, 1987 and assigned Ser. No. 047,811. The plasma torch advantageously provides some of the energy for melting scrap iron and steel independent of coke combustion. Utilizing this energy allows charging the cupola with material which would be blown from the bed if combustion of coke supplied all the energy. The plasma fired cupola also provides temperature, atmospheric and feed variations not permissible in regular cupolas.

An application entitled, "Replacement of Foundry Coke in a Plasma-Fired Cupola" filed May 8, 1987 and assigned Ser. No. 047,808 is related to this application and describes how other fuels can be substituted for coke and how fuel and alloying materials can be mixed.

An application entitled, "Control of Plasma-Fired Cupola" filed May 8, 1987 and assigned Ser. No. 047,810 is also related to this application and describes how the plasma-fired cupola is controlled.

A paper entitled "Test Results on a Pilot Scale Plasma Fired Cupola For Iron Ship Melting" was published by the inventor July 1985 and describes test results obtained when operating the cupola bus does not present the operating details disclosed hereinafter.

U.S. Pat. No. 4,530,101 entitled "Electric Arc Fired Cupola For Remelting Of Metal Chips" describe using plasma torches to melt metal chips being fed to the cupola via chip feed nozzles, but does not describe charging the cupola with metal chips.

SUMMARY OF THE INVENTION

In general, a method for operating a plasma-fired cupola in accordance with this invention, comprises the steps of: providing a plasma torch and feed nozzle adjacent a lower portion of the cupola; providing a charging door adjacent an upper portion of the cupola; providing a metal charge consisting of turnings and larger scrap, the larger scrap making up generally at least 25% by weight of the metal charge; providing a coke charge generally 5 to 15% by weight of the metal charge; providing a fluxing material charge generally 5 to 10% by weight of the metal charge; placing the metal, coke and fluxing material charges in the cupola; and operating the plasma torch to produce iron in the cupola.

BRIEF DESCRIPTION OF THE DRAWINGS

The objects and advantages of this invention will become more apparent by reading the following detailed description in conjunction with the accompanying drawings, in which.

DESCRIPTION OF THE PREFERRED EMBODIMENT

Figure 1:
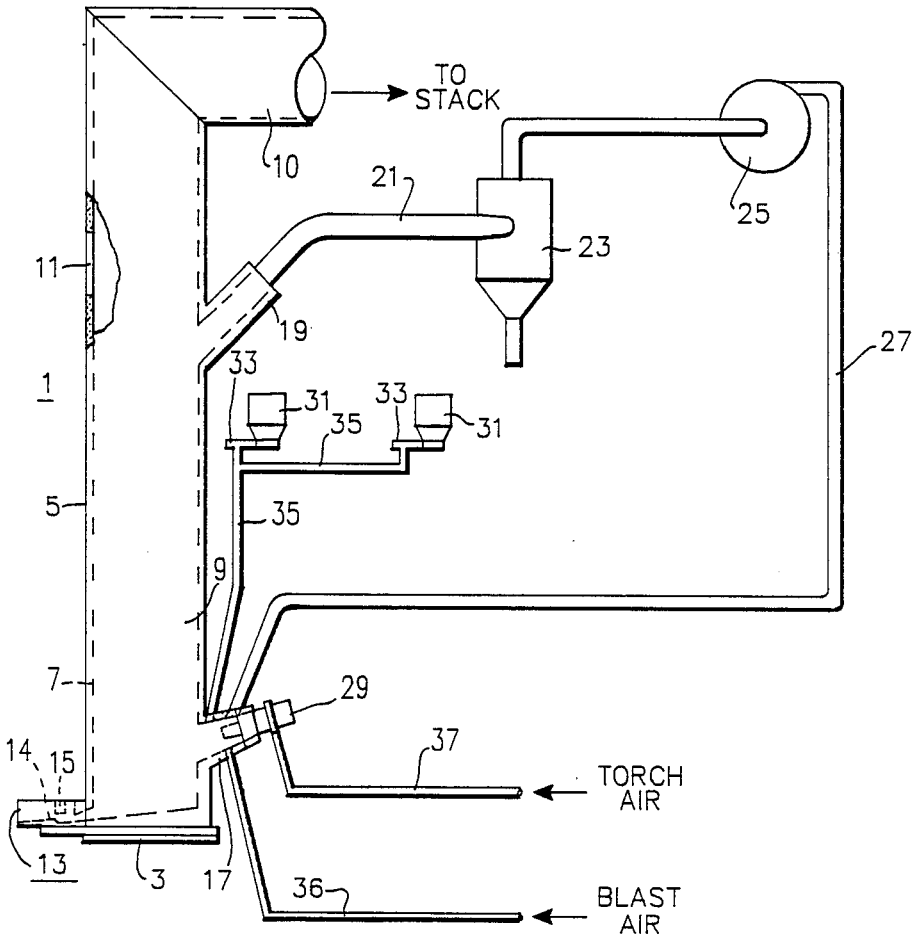
FIG. 1 is a schematic view of a plasma-fired cupola.

Referring now to the drawings in detail, there is shown a plasma-fired cupola 1 which is a furnace having a base portion 3 and a vertical cylindrical housing 5 extending upwardly from the base 3. The base 3 and housing 5 are lined with fire brick or other refractory material 7 generally forming an unobstructed round open shaft 9 with an off-gas conduit 10 connecting the upper end of the shaft 9 to a stack (not shown).

A charge door comprising of an opening 11 is disclosed adjacent the upper end of the shaft 9 for placing a charge normally comprising coke, scrap iron or steel and a fluxing material in the cupola 1.

Disposed adjacent the base portion 3 is a spout portion 13 having a dam 14 and skimmer 15 which separates melted iron and slag which are separately drawn from the spout 13.

A plasma torch nozzle 17 is disposed in fluid communication with the lower portion of the shaft 9. The plasma torch nozzle 17 is described in detail in an application entitield "Plasma Fired Feed Nozzle" filed May 8, 1987 and assigned Ser. No. 04,781 which is hereby incorporated by reference.

An off-gas nozzle or take-off 19 is disposed in fluid communication with the shaft 9 generally below the charge opening 11, however, its location is not critical, but necessarily above the charge level. A conduit or duct 21 extends from the off-gas nozzle or take-off 19 to a cyclone separator 23 utilized to remove particulate material from the off-gas. There is a blower 25 disposed in a conduit or duct 27 which provides fluid communication between the cyclone separator 23 and the plasma torch nozzle 17. A plasma torch 29 is disposed on an end of the plasma torch nozzle 17 opposite the end opening into the cupola 1. Two particulate material bins 31 are disposed above the plasma torch nozzle 17 each bin 31 has a screw auger 33 or other means for feeding particulate material from the respective bin 31 at a controlled rate to a conduit 35 which directs the particulate material to the plasma torch nozzles 17.

A blast air conduit or duct 36 is disposed in fluid communication with the plasma torch nozzle 17 to supply combustion air necessary to burn the coke. A torch air conduit 37 supplies air to the plasma torch 29.

Figure 2:
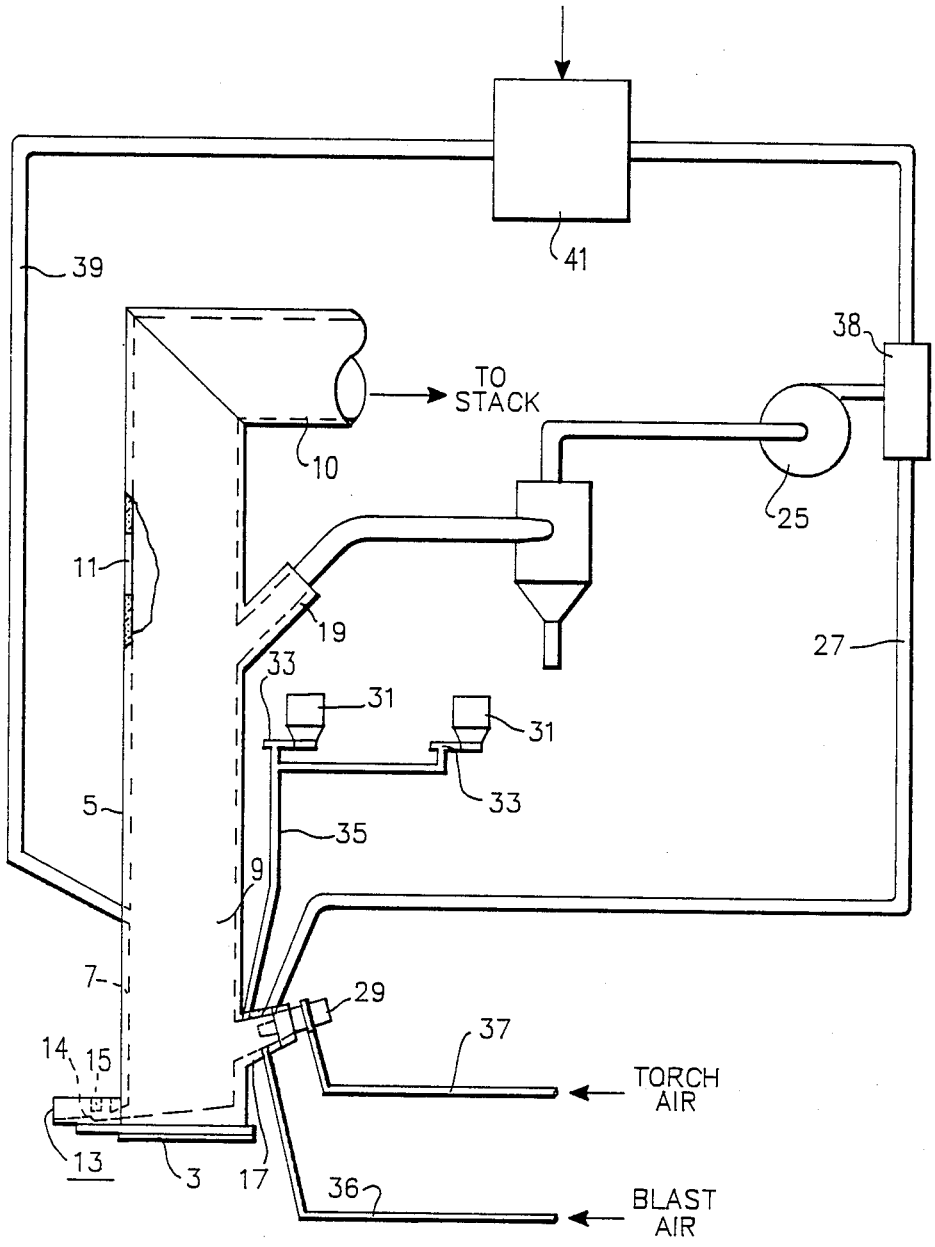
FIG. 2 is a schematic view of an alternative plasma-fired cupola.

FIG. 2 shows a plasma-fired cupola 1 with the items shown in FIG. 1 and also shows a flow splitter 38 which proportions the off-gas from the blower 25 between the conduit 27 and a conduit or duct 39 which returns some of the off-gas to a lower portion of the shaft 9. A combustor 41 is disposed in the conduit 39 to burn the combustible products in the off-gas and add heat energy to the cupola 1.

The operation of the plasma-fired cupola is as follows: A metal charge is made up of turnings and large scrap in which the large scrap generally makes up at least 25% by weight of the metal charge. The term "turnings" as used herein are intended to include scrap metal from machining steel or cast iron parts and include borings, chips and turnings and may be any shape having a large surface area to volume or be relatively small in size. The turnings may come directly from machining operations and be coated with machining cooling fluids, which normally are emulsions of oil and water. Layered with the metal charge is coke generally in quantities of 5 to 15% by weight of the metal change and a fluxing material such as limestone, which is generally in quantities of 5 to 15% by weight of the weight of the metal charge. An initial charge of coke is placed in the bottom portion of the cupola ignited by the plasma torch 29 and burned to heat the cupola to a predetermined temperature. Then coke, metal and limestone are layerd as they are dumped into the shaft 9 through the charging opening 11 to a level below the opening 11. The plasma torch 29 power level is controlled and the proper amount of blast air is fed through the blast air conduit 36 and combustion is sutained. The temperature of the mixed gases leaving the plasma feed nozzle is generally in the range of 2500° F. or 1370° C. The gas flow through the plasma-fired cupola is generally much lower than through a regular cupola generally less than 1 SCFM and preferably about 0.9 SCFM per sq. inch of cupola cross-sectional area, $2.7\times10^{-3}$ cu. meters per second per square cm, and this lower gas flow results in less gas flowing out of the stack and advantageously allows the cupola charge to include small metal particles, which in regular cupolas would blow up the stack or become oxidized. By varying the power level of the plasma torch, coke-to-metal ratios can also be varied. The plasma torch 29 also allows the turnings to be oily and wet as the plasma torch 29 can provide the energy necessary to dry out the charge and ignite the coke even if the charge is wet when it is dumped into the cupola.

Recycling a portion of the off-gas as shown in FIG. 1 or 2 produces a reducing atmosphere preventing oxidation of scrap having a large surface area and reducing the amount of coke being burned. Reducing the amount of coke being burned also reduces the sulfur content of the iron formed as the scrap metal melts. The reducing atmosphere also prevents the oxidation of alloying materials. Ferrous-alloys such as those silicon and manganese or other alloying elements may be added to the cupola from the bins 31 in granular form via the plasma torch nozzle 17. The plasma torch is operated at high power levels, supplying the energy to melt the ferrous-alloys 7, and the reducing atmosphere produced by the recycled off-gas cooperates in such a way that very small quantities are lost through oxidation and a greater amount end up in the iron compared to adding the ferrous-alloys with the charge as is done in regular cupolas. Also, the adjustment of the chemical composition of the iron is accomplished more rapidly by adding the ferrous-alloys through the plasma torch nozzle 17.

Particulate carbon in the form of pulverized coke may also be added via the plasma torch nozzle and bin 31 to substantially increase the carbon content of the motlen iron rapidly.

Alloying oxides may also be fed via the plasma torch nozzle 17 because of the reducing atmosphere created by recirculating the off-gases through the palsma torch and/or also by adding the pulverized coke along with the alloy oxide which produces a high reducing atmosphere and very rapidly affects the chemistry of the iron being produced.

The plasma-fired cupola and method of operating it advantageously allow the melting of metal borings, turnings or chips which can comprise up to 75% of the metal charge with the remaining 25% being thin metal scrap and the metal charge may also be wet and oily. The metal-to-coke ratio can be as high as 70:1; off-gas can be recirculated via the plasma torch or directly to the shaft or a combination thereof to achieve such metal-to-coke ratios. The addition of ferrous-alloy granules and/or alloy oxides via the plasma torch feed nozzle 17 can rapidly adjust the chemistry of the iron produced. Particulate carbon, i.e., in the form of pulverized coke, can also be added by itself or with alloy oxides to rapidly adjust the chemistry of the iron. The power level of the torch 29 may be varied and the recycling of off-gas through the plasma torch nozzle 17 or directed to a lower portion of the shaft produce a reducing atmosphere which can reduce oxides of iron or alloying metals substantially reducing the costs producing high grade iron in the plasma-cupola.

What is claimed is:

1. A method of operating a cupola to melt scrap iron comprising the steps of:

providing a plasma torch and feed nozzle adjacent the lower portion of the cupola;

providing a charging door adjacent an upper portion of the cupola;

providing a metal charge consisting of turning and large scrap, the larger scrap making up generally at least 25% by weight of the metal charge;

providing a coke charge generally 5 to 15% by weight of the metal charge;

providing a fluxing material charge generally 5 to 10% by weight of the metal charge;

dumping the coke, metal and fluxing charges into the cupola;

operating the plasma torch and controlling the gas flow rate within the cupola to prevent the turnings from being picked up by the gas flow to produce an iron in the plasma-fired cupola.

2. The method of operating a plasma-fired cupola as set forth in claim 1 wherein the gas flow rate is in the range of 0.9 SCFM/sq. inch of cupola cross-section through the charge in the cupola.

3. The method of operating a plasma-fired cupola as set forth in claim 2 and further comprising the step of providing a gas temperature from the plasma torch and feed nozzle in the range of 2500° F.

4. The method of operating a plasma-fired cupola as set forth in claim 3 and further comprising the step of recycling gas from the cupola to the feed nozzle to produce a reducing atmosphere.

5. The method of operating a plasma-fired cupola as set forth in claim 1 wherein the step of providing a metal charge consists of turnings and larger scraps comprises providing cast iron burnings.

6. The method of operating a plasma-fired cupola as set forth in claim 1, wherein the step of providing a metal charge consisting of turnings includes utilizing turnings coated with oil and water.

7. The method of operating a plasma-fired cupola as set forth in claim 4, wherein the step of operating the plasma torch comprising operating the plasma torch at a level which substantially reduces the amount of coke burned in order to reduce the sulfur content of the iron produced.

8. The method of operating a plasma-fired cupola as set forth in claim 1 and further comprising the step of adding particulate material to the feed nozzle to change the chemical composition of iron produced.

9. The method of operating a plasma-fired cupola as set forth in claim 8, wehrein the step of adding particulate material includes adding fine coke to rapidly increase the carbon content of the iron produced.

10. The method of operating a plasma-fired cupola as set forth in claim 9, wherein the step of adding particulate material includes adding ferrous-alloy particles to rapidly adjust the chemical composition of the iron.

11. The method of operating a plasma-fired cupola as set forth in claim 8, wherien the step of adding particulate material includes adding ferrous-alloy particles to rapidly adjust chemical composition of the iron.

12. A method of operating a plasma-fired cupola as set forth in claim 9, wherein the step of adding particulate material includes adding an alloy oxide to rapidly adjust the chemical composition of the iron produced.

13. The method of operating a plasma-fired cupola as set forth in claim 8, wherein the step of adding particulate materials including adding alloy oxide to rapidly adjust the chemical composition of the iron produced.

14. The method of operating a plasma-fired cupola as set forth in claim 10, wherein the step of adding particulate material includes adding an alloy oxide to rapidly adjust the chemical composition to the iron produced.

* * * * *

UNITED STATES PATENT AND TRADEMARK OFFICE

Certificate

Patent No. 4,780,132 Patented: Oct. 25, 1988

On petition requesting issuance of a certificate for correction of inventorship pursuant to 35 USC 256, it has been found that the above-identified patent, through error and without any deceptive intent, improperly sets forth the inventorship. Accordingly, it is hereby certified that the correct inventorship of this patent is:

Shyam V. Dighe, William H. Provis, Bradley T. Buczkowski and Walter J. Peck

Signed and Sealed this Fourteenth Day of November, 1989

L. DEWAYNE RUTLEDGE

*Supervisory Primary Examiner*
*Patent Examining Group 110*